US006412659B1

(12) United States Patent
Kneer

(10) Patent No.: US 6,412,659 B1
(45) Date of Patent: Jul. 2, 2002

(54) CONTAINER AND PUMP ASSEMBLY

(75) Inventor: Roland Kneer, Farchant (DE)

(73) Assignee: Gaplast GmbH, Altenau (DE)

( * ) Notice: Subject to any disclaimer, the term of this patent is extended or adjusted under 35 U.S.C. 154(b) by 0 days.

(21) Appl. No.: 09/508,893

(22) PCT Filed: Aug. 21, 1998

(86) PCT No.: PCT/DE98/02444

§ 371 (c)(1),
(2), (4) Date: Mar. 17, 2000

(87) PCT Pub. No.: WO99/16552

PCT Pub. Date: Apr. 8, 1999

(30) Foreign Application Priority Data

Sep. 26, 1997 (DE) ..... 197 42 559
Mar. 14, 1998 (EP) ..... 98104631

(51) Int. Cl.[7] ..... B67D 5/00

(52) U.S. Cl. ..... 222/82; 222/105; 222/136; 222/321.9

(58) Field of Search ..... 222/82, 80, 145.1, 222/129, 136, 321.9, 321.7, 321.6, 321, 183, 385, 92, 94, 105, 145.5

(56) References Cited

U.S. PATENT DOCUMENTS 3,347,410 A * 10/1967 Schwartzman ..... 206/222
4,076,147 A * 2/1978 Schmit ..... 222/105
4,152,378 A * 5/1979 Vcelka et al. ..... 128/200.13
4,457,455 A * 7/1984 Meshberg ..... 222/105
4,770,323 A * 9/1988 Debard ..... 222/382
4,821,923 A * 4/1989 Skorka ..... 206/219
4,982,875 A * 1/1991 Pozzi et al. ..... 222/83
5,025,955 A * 6/1991 Stenger ..... 222/400.8
5,127,548 A * 7/1992 Brunet et al. ..... 222/145.1
5,343,901 A * 9/1994 Meshberg ..... 141/18
5,503,302 A * 4/1996 DeJonge ..... 222/153.13
5,509,578 A * 4/1996 Livingstone ..... 222/321.6
5,642,838 A * 7/1997 Stoody ..... 222/105
5,860,569 A * 1/1999 Gregoire ..... 222/129
5,873,491 A * 2/1999 Garcia et al. ..... 222/321.7

* cited by examiner

*Primary Examiner*—Joseph A. Kaufman
*Assistant Examiner*—Patrick Buechner
(74) *Attorney, Agent, or Firm*—Pyle & Piontek

(57) ABSTRACT

The neck of the container has arranged therein a tightly fitting insert comprising a bottom which is closed in an initial state and which, prior to the activation of a pump engaging with its end section into the insert, is opened in that a housing part of the pump is screwed forwardly in the axial direction of the container. The bottom of the insert and the pump have provided thereinbetween a receiving chamber for an active substance which, after the bottom has been opened, is mixed with a liquid contained in the container. A liquid drug containing an active substance which has no long-time stability can thus be discharged with a vacuum pump after a long storage period.

7 Claims, 2 Drawing Sheets

CONTAINER AND PUMP ASSEMBLY

BACKGROUND OF THE INVENTION

The present invention relates to a container comprising a pumping means for discharging a liquid container content, such as a liquid drug. The container is preferably shaped in the form of a small bottle comprising a bottle neck having seated thereon a spray pump or a vacuum pump which, when the upper pump part is depressed in the direction of the bottle neck, sucks a predetermined amount of the liquid content of the container into a chamber of the pump and then, with the next pump lift, ejects said amount out of fine channels of the upper pump part, whereby the liquid is finely atomized at an exit nozzle. The liquid, however, can also be discharged in drops. Such pumps are e.g. widely used for spraying a liquid drug into the nose.

Preferably, the invention relates to containers that have been produced in a coextrusion type blow molding process and consist of a rigid outer container and a soft inner bag the materials of which do not form a welded joint with one another. In the preferred containers the bottom seam of the inner bag which has been closed by squeezing off the tubular parison in the blow mold is clamped in an outwardly projecting bottom web of the outer container, the outer web being also closed by means of a weld which has been formed in that the weld of the inner bag has retracted from the point of separation by reason of an accumulating effect in the molding section forming the bottom seam of the outer container. The wall of the outer container contains pressure compensating openings which can e.g. be formed by unwelded shoulder seams of the outer container or by the measure that a chip of the outer container is cut away at a flat angle on a convex section, with the inner bag being not damaged upon impingement of the knife on said bag, but being pressed away inwards. While the liquid container content is gradually discharged, the inner bag is more and more contracted, with ambient air entering for the purpose of pressure compensation through the pressure compensating openings into the space formed between the outer container and the inner bag.

The invention, however, is not limited to the use of such a container, but the container may e.g. be a standard small glass or plastic bottle which is provided with a filter for the air flowing thereinto for the purpose of pressure compensation. The container need not necessarily have the shape of a bottle with a bottle neck.

Furthermore, the container of the invention is intended to receive a liquid drug and will be described in the following with reference to such an example, although it should be noted that it is also suited for receiving and discharging another liquid if it consists of two substances, namely a solvent first contained in the container and an active substance which is first stored separately in a second chamber of the container and is preferably present in a solid state.

Some pharmaceutical active substances, such as hormones, do not have a long-time stability when dissolved in a liquid, which is above all the case when no preserving agents can be added. To remedy such a drawback, it is known that such active substances are stored in a freeze-dried state and, prior to use, are discharged into a solvent with which the active substance in the dissolved state forms a liquid drug which e.g. can be administered by means of a pipette or a syringe.

It is the object of the present invention to provide a container with a pumping means which is suited for receiving and discharging a liquid with an active substance that has no long-time stability.

SUMMARY OF THE INVENTION

According to the invention the opening of the container, preferably the container neck if such a member exists, has arranged therein a substantially tubular insert which tightly rests on the edge of the opening and comprises a bottom which is closed in a first state of the arrangement and which prior to a first discharging of the liquid container content is opened by the action of a force. Furthermore, the front end section of the pumping means, which is preferably provided as an airless pump, is intended to engage into the insert, with the circumferential wall of said front end section or suction section tightly resting on the wall of the insert, and the circumferential wall being displaceable in the axial direction of the container relative to the insert upon the action of a corresponding force. Furthermore, it is intended that the bottom of the insert and the end of the pumping means have provided thereinbetween a receiving chamber which can receive a substance which in the closed state of the bottom is separated from a second substance contained in the remaining inner chamber of the container. However, when the bottom of the insert is opened or torn open by pushing the pumping means forwards, the substance inside the insert exits from the insert and can be mixed with the substance in the container. In the insert preferably a freeze-dried active substance of a drug is first isolated from a solvent contained in the container, e.g. sterile water, and mixed with said liquid after the bottom has been opened. However, as already stated above, the invention is not limited to the last-mentioned feature.

Expediently, the substantially tubular insert has a cylindrical shape provided that the bottle neck of the container and the front housing section of the pumping means have a corresponding cylindrical shape, though with a larger or smaller diameter.

The bottom of the insert, preferably the inside thereof, has formed thereon a groove which extends either in surrounding fashion or in almost surrounding fashion over the whole circumference and whose cross-section may approximately have the shape of a V and forms a weakened seam on which the bottom is torn open upon the action of a force. It is particularly preferred here that the pumping means comprises a tubular projection which projects beyond the front end portion with the ball valve and which is in alignment with the surrounding groove of the bottom and is obliquely cut away at its free end so that first, while the pumping means is pushed forwards into the container, the projection only enters with its tip into the groove, thereby tearing open the seam at a high press force, with an increasing circumferential portion further tearing open the weakened seam while the advance movement is continued so that finally the bottom is folded downwards into the position of use and the content of the insert is entirely released. The projection is preferably formed in that the circumferential wall of the front suction portion of the pumping means is extended beyond the valve portion.

The insert expediently rests with an annular shoulder on the upper side of the container or the upper edge of the container neck if such a neck exists.

Furthermore, it is of great advantage when the outer side of the container has arranged thereon an additional circumferential wall which is gripped over in part by a housing part of the pumping means which is axially displaceable. The additional circumferential wall expediently forms part of an outer cap which at least grips around the lower portion of the container. The outer cap can here also extend up to the upper edge of the container.

Furthermore, the outer cap is provided on its upper edge with a thickened portion having an outwardly projecting annular shoulder while the housing part of the pumping means is provided on its lower edge with a thickened portion having an inwardly projecting annular shoulder. Thus, the thickened portion of the outer cap faces the inner wall of the housing part while the thickened portion of the housing part faces the outer wall of the outer cap. In the adjoining state of the two annular shoulders, the pumping means is in the retracted initial position in which the bottom of the insert is closed and the substance received therein is separated from the remaining interior of the container.

To enable the housing part with its annular shoulder to grip over the outer cap or the thickened portion thereof, it is further suggested that the two annular shoulders should be provided on the outside with slopes or inclined portions which, when the housing part is advanced in the direction of the outer cap, will impinge on each other, whereby the area of the thickened portion of the housing part of the pump is radially expanded while the housing part with its thickened portion is sliding over the thickened portion of the outer cap. As a result, these two parts can be put together easily.

Furthermore, it is suggested that either the thickened portion of the outer cap or the thickened portion of the housing part has a small radial overdimension of such a configuration that said thickened portion rests under a pre-load on the associated wall of the respectively other part. A surrounding groove into which the thickened portion with the radial overdimension locks in place is formed in said other wall at an axial distance from the thickened portion. Said groove defines the position of the pumping means in which the bottom of the insert is torn open and unfolded and in which the arrangement is in a state in which the container content can be discharged by the pumping means.

Hence, two axial positions of the pumping means relative to the container are defined by the engagement of the outer cap with the housing part of the pumping means, namely the retracted initial position by the contact of the annular shoulders with one another and the ready-for-use position extended into the container, in which the one thickened portion is locked in place in the associated groove.

In a particularly preferred embodiment the container is seated in an outer cap which can extend up to the upper edge of the container neck. On its upper edge portion the outer cap is provided with a thread which is preferably provided on the outside of the outer cap. An inner thread of a housing part of the pumping means is in engagement with said thread.

The pumping means is pushed with its suction section forwards into the container by rotation of the housing part until an annular shoulder of another housing part of the pumping means impinges onto the container whereby the operative position of the pumping means is defined. In said state the front end section of the pumping means has torn open and unfolded the bottom of the insert, so that the active substance can enter into the container.

The pumping means can be pushed forwards with its suction section continuously and smoothly into the container owing to said screwing operation, whereby the suction section is reliably prevented from getting jammed in the insert. The force required for tearing the bottom open can also be applied without any problems by a person who is not so skilled, thanks to the screwing action.

It is of great advantage that a sawtooth-type thread is used as the thread. The threaded sections are preferably so short that in the advanced end position the thread of the housing part is screwed beyond the thread of the outer cap, so that the housing part of the pumping means can no longer be screwed back. It is reliably prevented by said self-locking action of the thread, which can also be achieved by other means, that the pumping means is moved out of its operative position.

BRIEF DESCRIPTION OF THE DRAWINGS

Further details of the invention will become apparent from the following description of preferred embodiments of the invention and from the enclosed drawing, in which.

DETAILED DESCRIPTION OF THE INVENTION

The figures show a bottleshaped container 1 comprising a neck 2 which has arranged therein an insert 3 which rests with an outwardly oriented annular shoulder 4 on the upper edge of the bottle neck 2. The insert 3 has a circular cylindrical shape and tightly rests on the inner wall of the container neck 2.

Figure 1:
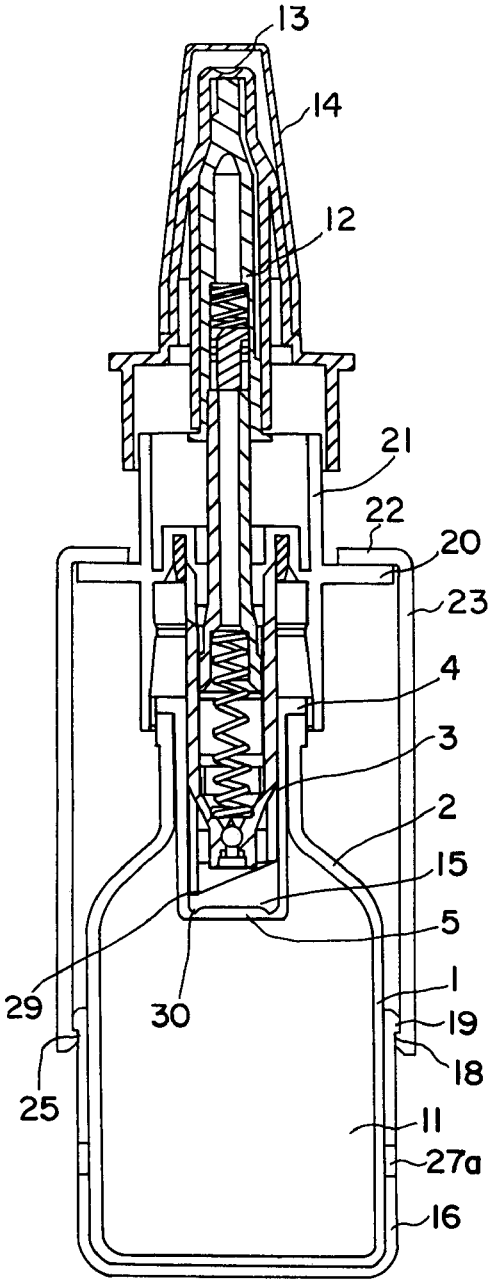
FIG. 1 is a vertical section through a first embodiment of a container with a pumping means in the initial state.

The insert 3 has a bottom 5 which is closed in the initial state of the arrangement as shown in FIG. 1. A surrounding V-shaped groove 30 which constitutes a predetermined breaking seam is formed in the inner wall of the bottom 5.

The insert 3 is engaged by the front end or suction section 31 of a pumping means, designated by reference numeral 6 on the whole. The pumping means is provided in the conventional manner in the area of the suction opening 7 with a ball valve 8 which upon application of an overpressure closes the suction opening 7 and upon application of a negative pressure is lifted from the valve seat so that the front suction chamber 9 can be filled with liquid sucked from the container chamber 11 by the lift of the upper pump part due to the force of the helical spring 10. Upon a renewed pump lift the liquid is discharged from fine channels 12 of the upper part of the pumping means and from an atomizing nozzle 13. Of course, the cap 14 shown in the figures has been removed previously. A detailed description of the known components of the pumping means can here be dispensed with.

The lower suction end of the pumping means 6 and the bottom 5 of the insert 3 have located thereinbetween a second receiving chamber 15 in which, for instance, an active substance which has no long-time stability when dissolved and forms part of a drug which is liquid in the discharged state can be stored in a freeze-dried state as long as the drug is not to be administered.

The small bottle 1 is received in its lower portion in a cup-shaped outer cap 16 which tightly rests on the outer wall of the small bottle. The outer cap 16 is provided at its upper end with an outwardly oriented, surrounding thickened portion 17 with a lower annular shoulder 18 and at the upper side with a slope 19.

An outwardly oriented annular shoulder 20 of a pump part 21 is gripped over by an inwardly oriented annular flange 22 of a housing part 23 of the pump means 6, said housing part 23 extending with a cylindrical outer wall 24 partly beyond the cylindrical outer wall of the outer cap 16. The housing part 24 is also provided at its lower end with a surrounding thickened portion 25 having an annular shoulder 25*a* positioned at the top and a slope 26 positioned thereunder.

In the initial position of the arrangement as shown in FIG. 1, the annular shoulder 25 of the housing part 23 rests on the annular shoulder 18 of the outer cap. The initial position of the pumping means 6 which is retracted from the small bottle 1 is defined thereby.

Figure 2:
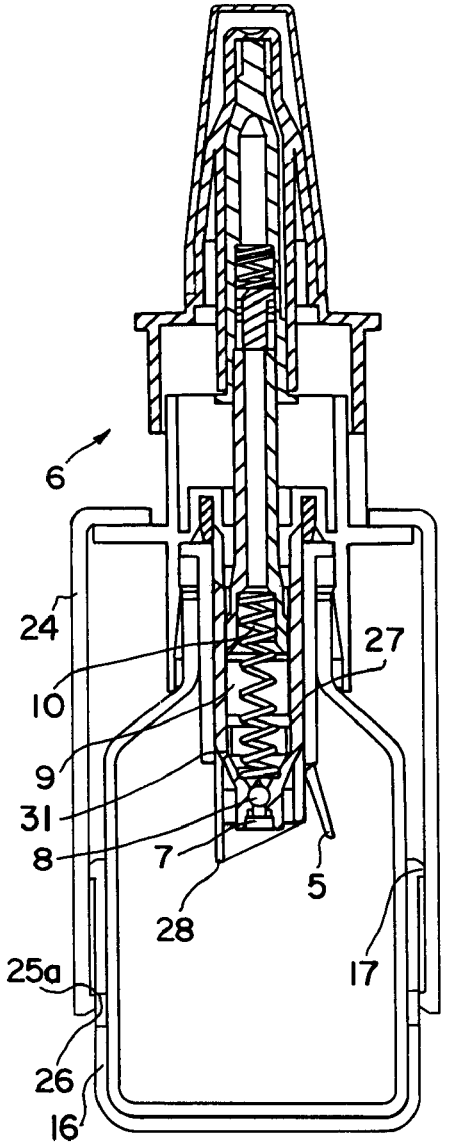
FIG. 2 is a vertical section through the arrangement according to FIG. 1 in a state in which the content of the container can be discharged.

The annular thickened portion of the housing part 23 is slightly overdimensioned radially inwards so that the thickened portion rests under a certain preload on the outer wall of the outer cap 16. A surrounding annular groove 27*a* into which the thickened portion of the housing 23 snaps upon insertion of the pumping means into the small bottle 1 in the liquid discharging position as shown in FIG. 2 is provided in the outer wall of the outer cap 16 at a predetermined distance from the thickened portion 17 of the outer cap. The discharge position of the pumping means is thereby fixed.

The pumping means 6 is tightly seated in the insert 3 with the circumferential wall 27 surrounding the suction chamber 9. The circumferential wall 27 is continued (in the figures in downward direction) in a tubular projection 28 which is obliquely cut away at its end and projects over the suction opening 7 of the pumping means 6.

Upon insertion of the pumping means into the small bottle 1 and into the end position shown in FIG. 2, the tubular projection 28 first impinges with its axially front tip 29 (left in the figure) onto the bottom 5, strictly speaking, into the V-shaped groove 30, whereby the predetermined breaking seam is torn open until the bottom 5 is folded away downwards in the way as can be seen from FIG. 2. In this state the active substance contained in chamber 15 is released so that it can be mixed with a solvent contained in the chamber 11 of the small bottle 1.

Figure 3:
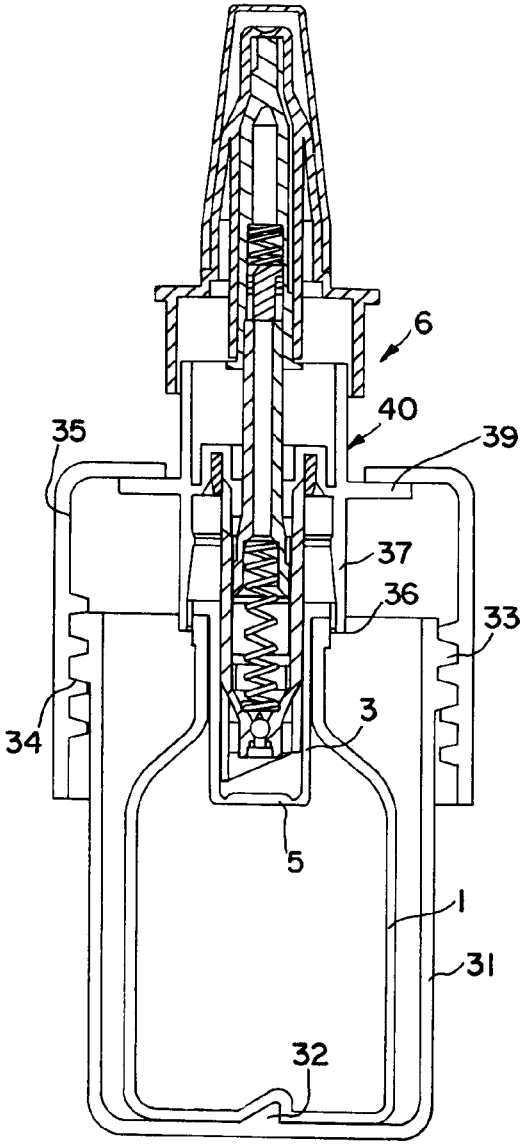
FIG. 3 is a vertical section through a second embodiment of a container with a pumping means in the initial state.
Figure 4:
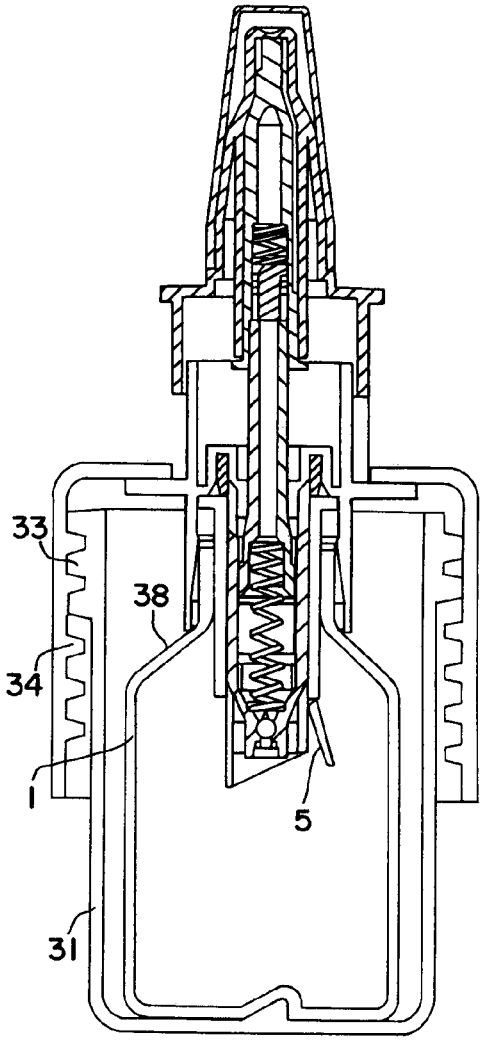
FIG. 4 is a vertical section through the arrangement according to FIG. 3 in a state in which the content of the container has exited from the insert.

In the second embodiment of the invention, which is shown in FIGS. 3 and 4, the outer cap 31, in which the container 1 is arranged, extends up to the upper edge of the container neck. The container 1 is seated with a radial play in the outer cap 31 and is connected thereto for rotation therewith in that a web 32 projecting from the bottom of the outer cap 31 engages into a correspondingly shaped bottom groove of the container 1.

In its upper end portion, the outer cap 31 comprises an axially short threaded section 33 which is engaged by a threaded section 34, also of an axially short length, on the inside of the housing part 35 of the pumping means 6. A sawtooth-type thread is here preferred.

The bottom 5 of the insert 3 is torn open in that the housing part 35 is screwed forwards clockwise, thereby sliding onto an annular attachment (39) of another housing part (40) of the pumping means until a front edge 36 of a housing part 37 impinges on the shoulder section 38 of the container 1. In this final position, the bottom 5 of the insert 3 is torn open, as outlined in FIG. 4.

In said position, the threaded section 34 of the housing part 35 is no longer in engagement with the threaded section 33 of the outer cap 31 so that it is not possible for a user to screw the housing part 35 back again into the initial state.

What is claimed is:

1. A container and pump assembly for mixing and discharging two agents, said assembly comprising a container having an opening, a substantially tubular insert tightly fitted in the opening, a lower portion of said insert defining a receiving chamber for holding an active substance, said receiving chamber having a tearable bottom wall, an airless pump having an axially movable portion tightly slidable in the insert and movable toward the container, said axially movable portion serving to tear open the bottom wall and completely discharge the active substance from the receiving chamber into the container, said container comprising an outer rigid portion having openings and an inner flexible bag containing a liquid, said airless pump serving to suck and dispense the mixture of said active substance and said liquid in an airless fashion.

2. The assembly of claim 1 wherein bottom wall comprises a surrounding groove around the edge of the wall.

3. The assembly of claim 2 wherein the axially movable portion of the pump comprises a tubular projection in alignment with the groove.

4. The assembly of claim 1 additionally comprising an outer cap surrounding the lower part of the container and wherein the pump additionally comprises a housing part in axial engagement with the cap.

5. The assembly of claim 4 herein the outer cap and housing part are in threaded engagement.

6. The assembly of claim 4 wherein an outwardly projecting annular shoulder is provided on the upper edge of the cap, and an inwardly projecting annular shoulder is provided on the hosing part.

7. The assembly of claim 6 wherein the annular shoulder of the outer cap and the annular shoulder of the housing part have different radial dimensions and are under a load.

* * * * *